US011721902B2

(12) United States Patent
Rahikkala et al.

(10) Patent No.: US 11,721,902 B2
(45) Date of Patent: Aug. 8, 2023

(54) WIDE BAND LOOP TYPE GROUND RADIATING ANTENNA

(71) Applicant: Silicon Laboratories Inc., Austin, TX (US)

(72) Inventors: Pasi Rahikkala, Vihti (FI); Tuomas Hänninen, Helsinki (FI); Attila Zólomy, Budapest (HU)

(73) Assignee: Silicon Laboratories Inc., Austin, TX (US)

( * ) Notice: Subject to any disclaimer, the term of this patent is extended or adjusted under 35 U.S.C. 154(b) by 0 days.

(21) Appl. No.: 17/325,548

(22) Filed: May 20, 2021

(65) Prior Publication Data

US 2022/0376395 A1 Nov. 24, 2022

(51) Int. Cl.
*H01Q 1/48* (2006.01)
*H01Q 7/00* (2006.01)

(52) U.S. Cl.
CPC ..... *H01Q 7/00* (2013.01); *H01Q 1/48* (2013.01)

(58) Field of Classification Search
CPC ..... H01Q 7/00; H01Q 1/48; H01Q 7/005
See application file for complete search history.

(56) References Cited

U.S. PATENT DOCUMENTS

2008/0079642 A1* 4/2008 Ishizuka ..... H01Q 9/42 343/702
2011/0309985 A1* 12/2011 He ..... H01Q 5/371 343/700 MS
2018/0062254 A1 3/2018 Rahikkala et al.
2020/0127628 A1* 4/2020 Zolomy ..... H01Q 7/005
2022/0131271 A1* 4/2022 Hänninen ..... H01Q 7/00

OTHER PUBLICATIONS

Hassan et al., "A Wideband Loop-type Ground Radiation Antenna Using Ground Mode Tuning and Optimum Impedance Level", Microwave and Optical Technology Letters, pp. 1-6, 2019.
Liu et al., "Excitation Techniques of Loop Current Mode of Ground Antenna", IEEE Proceedings of 2011 Cross Strait Quad-Regional Radio Science and Wireless Technology Conference, Jul. 2011.

* cited by examiner

*Primary Examiner* — Hai V Tran
*Assistant Examiner* — Michael M Bouizza
(74) *Attorney, Agent, or Firm* — Nields, Lemack & Frame, LLC

(57) ABSTRACT

A loop type ground radiating antenna having dual resonance is disclosed. The antenna including a feeding path that traverses the ground clearance, creating a first portion and a second portion. One or more first capacitors are disposed along a first conductive path between the ground clearance and the edge of the ground layer, proximate the first portion, while one or more second capacitors are disposed along a second conductive path between the ground clearance and the edge of the ground layer, proximate the second portion. An input capacitor is used to feed the feeding path. The values of the input capacitor and the first capacitors determine a resonant frequency of the first feeding loop, while the values of the input capacitor and the second capacitors determine a resonant frequency of the second feeding loop. By proper selection of the capacitor values, a wide bandwidth may be created.

14 Claims, 6 Drawing Sheets

WIDE BAND LOOP TYPE GROUND RADIATING ANTENNA

This disclosure describes an antenna system, and more particularly to a loop type ground radiating antenna.

BACKGROUND

The explosion of network connected devices has led to an increased use of certain wireless protocols. For example, simple wireless network devices are being implemented as temperature sensors, humidity sensors, pressure sensors, motion sensors, cameras, light sensors, dimmers, light sources, and other functions. Additionally, these wireless network devices have become smaller and smaller.

These wireless network devices are typically equipped with an embedded antenna. In a typical product design, the antenna is matched and designed for that particular printed circuit board (PCB) and mechanics.

However, with modules, the installation with the end product cannot be controlled by the module manufacturer. By nature, the antenna characteristics and impedance depend on various factors, such as the PCB size and shape. Consequently, this creates a challenge for the antennas used in the modules. If the antenna is detuned and the impedance of the antenna is not within the specification required for that particular RF front end design, it can result to increased spurious emissions or degraded EVM performance.

For example, traditional ground antennas utilize a rectangular ground clearance and a single capacitor. The current path around the ground clearance forms the antenna radiator loop. In other words, the strong current loop allows the spread of loop-type current distributions on the ground layer to radiate outward. In this configuration, the value of the capacitor and the dimensions of the ground plane controls both the input impedance and the resonant frequency of the antenna.

Therefore, it would be advantageous if there were an antenna design that may be operated over a wide range of tolerances and PCB designs.

SUMMARY

A loop type ground radiating antenna having dual resonance is disclosed. The antenna including a feeding path that traverses the ground clearance, creating a first portion and a second portion. One or more first capacitors are disposed along a first conductive path between the ground clearance and the edge of the ground layer, proximate the first portion, while one or more second capacitors are disposed along a second conductive path between the ground clearance and the edge of the ground layer, proximate the second portion. An input capacitor is used to feed the feeding path. The values of the input capacitor and the first capacitors determine a resonant frequency of the first feeding loop, while the values of the input capacitor and the second capacitors determine a resonant frequency of the second feeding loop. By proper selection of the capacitor values, a wide bandwidth may be created.

According to one embodiment, a loop type ground radiation antenna is disclosed. The loop type ground radiation antenna comprises two resonance frequencies. In certain embodiments, the antenna comprising one or more first capacitors and one or more second capacitors, wherein values of the one or more first capacitors and the one or more second capacitors are used to determine the two resonance frequencies. In some embodiments, a ground clearance is divided into a first portion and a second portion by a feeding path, and wherein an area of the first portion and an area of the second portion is also used to determine the two resonance frequencies. In certain embodiments, the operating frequency is 2.45 GHz. In some embodiments, a first resonant frequency is between 2.1 GHz and the 2.45 GHz and a second resonant frequency is between 2.45 GHz and 2.8 GHz. In some embodiments, a return loss is less than −10 dB over a range of more than 800 MHz.

According to another embodiment, a loop type ground radiation antenna is disclosed. The loop type ground radiation antenna comprises a conductive ground layer; a ground clearance disposed in the ground layer, wherein the ground clearance is not electrically conductive, and wherein the ground clearance is disposed near an edge of the ground layer such that a conductive pathway exists between the ground clearance and the edge of the ground layer; a feeding path traversing the ground clearance to create a first portion and a second portion, wherein a first end of the feeding path contacts the conductive pathway, dividing the conductive pathway into a first conductive pathway and a second conductive pathway; an input capacitor in communication with a second end of the feeding path; one or more first capacitors arranged in series along the first conductive pathway; and one or more second capacitors arranged in series along the second conductive pathway. In some embodiments, an area of the first portion, and a total capacitance of the one or more first capacitors determine a first resonant frequency. In certain embodiments, an area of the second portion, and a total capacitance of the one or more second capacitors determine a second resonant frequency. In certain embodiments, the first resonant frequency is different from the second resonant frequency. In certain embodiments, the operating frequency is 2.45 GHz. In some embodiments, a first resonant frequency is between 2.1 GHz and the 2.45 GHz and a second resonant frequency is between 2.45 GHz and 2.8 GHz. In some embodiments, a return loss is less than −10 dB over a range of more than 800 MHz.

According to another embodiment, a module comprising the loop type ground radiation antenna described above is disclosed. In some embodiments, the ground layer of the loop type ground radiation antenna is adapted to be electrically connected to a ground layer of a printed circuit board. In certain embodiments, the operating frequency is 2.45 GHz. In some embodiments, a return loss is less than −10 dB over a frequency range from 2.4 GHz to 2.48 GHz for ground layers having a width between 40 mm and 80 mm and a length between 40 mm and 80 mm.

According to another embodiment, an assembly is disclosed. The assembly comprises the module described above and a printed circuit board, wherein a ground layer of the printed circuit board is in communication with the ground layer of the loop type ground radiation antenna. In certain embodiments, the operating frequency is 2.45 GHz. In some embodiments, a return loss is less than −10 dB over a frequency range from 2.4 GHz to 2.48 GHz for ground layers having a width between 40 mm and 80 mm and a length between 40 mm and 80 mm.

BRIEF DESCRIPTION OF THE DRAWINGS

For a better understanding of the present disclosure, reference is made to the accompanying drawings, in which like elements are referenced with like numerals, and in which.

DETAILED DESCRIPTION

Figure 1:
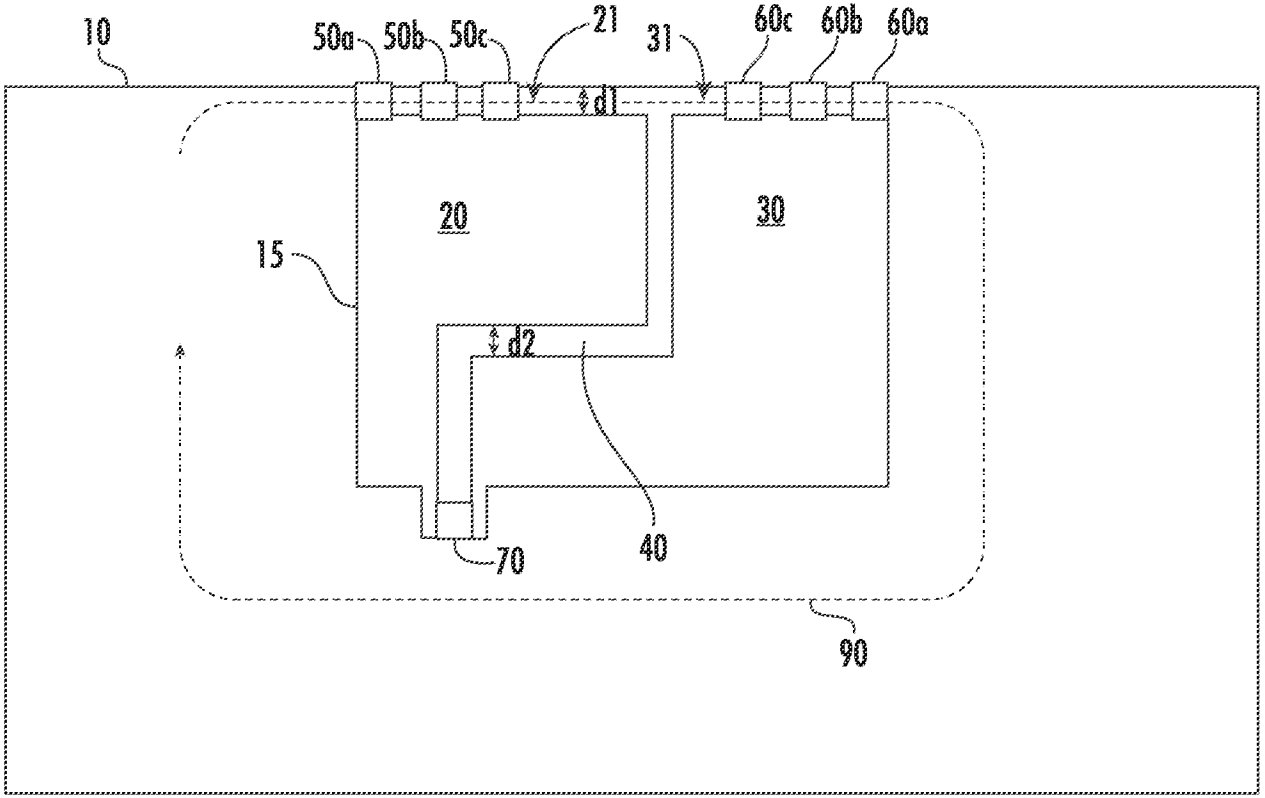
FIG. 1 shows the topology of the antenna according to one embodiment.

FIG. 1 shows the topology of an antenna that overcomes the issues of the prior art. The antenna radiates via the ground layer 10, which may be one layer of the printed circuit board. The antenna may be considered a loop type ground radiation antenna.

The ground layer 10 comprises a ground clearance 15 that is separated into two portions. The ground clearance 15 is a region of the ground layer 10, which is not electrically conductive. In certain embodiments, the metal that typically resides in this region is removed. The ground clearance 15 may be rectangular in shape. The dimensions of the ground clearance 15 may be selected based on the desired performance of the antenna. For example, the width of the ground clearance 15 affects the resonant frequency while the other dimension affects the bandwidth of the antenna. To achieve frequencies around 2.4 GHz, the ground clearance may be about 6.5 mm×8.5 mm, although other dimensions may be used for different frequency bands.

An antenna radiator loop 90 is created around the outside of the ground clearance 15. This antenna radiator loop 90 allows the spread of loop-type current distributions on the ground layer 10 to be radiated outward.

A feeding path 40 is disposed through the ground clearance 15, thereby dividing the ground clearance 15 into two portions; a first portion 20 and second portion 30. The feeding path 40 may be configured so that the first portion 20 and the second portion 30 having different areas.

The feeding path 40, like the rest of the ground layer 10, is a conductive material, such as copper. The width of the feeding path 40, labelled d2, may be about 0.5 to 1.0 mm.

While FIG. 1 shows the feeding path 40 as having three straight segments with two right angle turns, the disclosure is not limited to this embodiment. The feeding path 40 may be straight, have any number of turns, or be curved.

The ground clearance 15 may be formed near the edge of the ground layer 10, such that the distance, d1, between the edge of the ground layer 10 and the ground clearance 15 proximate that edge is about 0.5 mm. In certain embodiments, d1 may equal d2. Thus, a conductive pathway exists between the ground clearance 15 and the edge of the ground layer 10.

Further, this conductive pathway comprises two parts, which are defined as being on either side of the feeding path 40. There is a first conductive pathway 21 that is disposed between the first portion 20 and the edge of the ground layer 10; and a second conductive pathway 31 that is disposed between the second portion 30 and the edge of the ground layer 10.

One or more first capacitors 50*a*, 50*b*, 50*c* are disposed in series along the first conductive pathway 21, such that current passing along the first conductive pathway 21 must pass through the one or more first capacitors 50*a*, 50*b*, 50*c*. The one or more first capacitors 50*a*, 50*b*, 50*c* may have the same value or different values.

Similarly, one or more second capacitors 60*a*, 60*b*, 60*c* are disposed in series along the second conductive pathway 31, such that current passing along the second conductive pathway 31 must pass through the one or more second capacitors 60*a*, 60*b*, 60*c*.

Additionally, an input capacitor 70 is disposed between the feeding path 40 and the input source 80. The input source 80 may comprise an impedance matching circuit 82, which, in turn, is in communication with the power amplifier 81 of the radio circuitry.

Thus, the input capacitor 70, the first capacitors 50*a*,50*b*, 50*c*, and the feeding path 40 for one resonator, while the input capacitor 70, the second capacitors 60*a*, 60*b*,60*c*, and the feeding path 40 form a second resonator. Additionally, the ground layer 10 forms the radiator.

The values for each of the input capacitor 70, the first capacitors 50*a*,50*b*,50*c* and the second capacitors 60*a*,60*b*, 60*c* may be determined via simulation or empirical testing. In certain embodiments, these values are all less than 10 pF.

Figure 2:
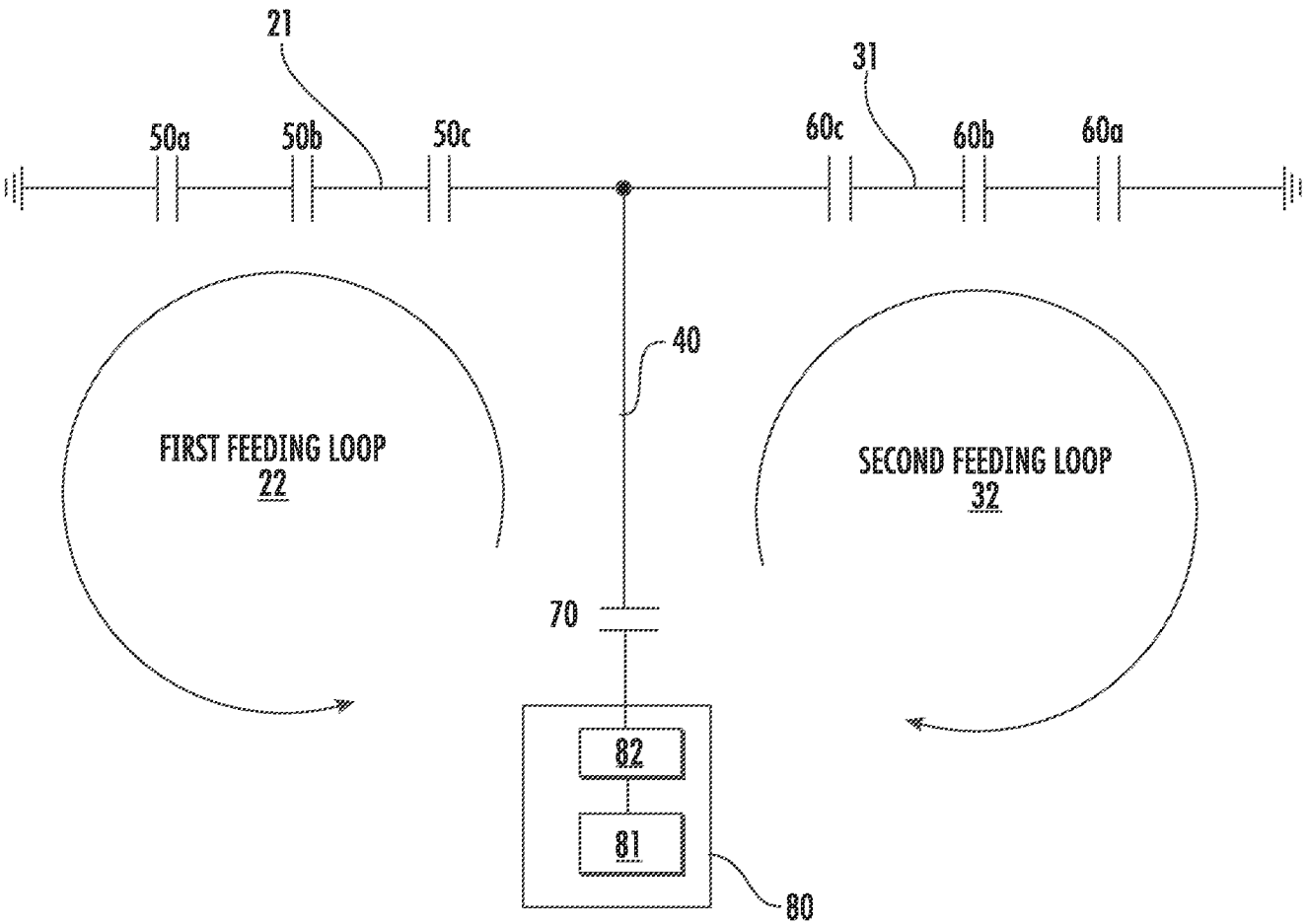
FIG. 2 is a schematic representation of the antenna in FIG. 1.

FIG. 2 shows a schematic that is representative of the topology shown in FIG. 1. Note that input source 80, the input capacitor 70, the feeding path 40, first capacitors 50*a*, 50*b*, 50*c*, and the first conductive pathway 21 form the first feeding loop 22. Likewise, the input source 80, the input capacitor 70, the feeding path 40, the second capacitors 60*a*, 60*b*, 60*c*, and the second conductive pathway 31 form the second feeding loop 32. In certain embodiments, the first feeding loop 22 may be a higher frequency feeding loop and the second feeding loop 32 may be a lower frequency feeding loop. Of source, the configuration can be reversed such that the first feeding loop 22 is the lower frequency feeding loop. Additionally, there is an antenna radiator loop that travels around the perimeter of the ground clearance 15, as shown in FIG. 1.

The values of the one or more first capacitors 50*a*, 50*b*, 50*c* and the area of the first portion 20 establish the resonant frequency of the first feeding loop 22. Similarly, the values of the one or more second capacitors 60*a*, 60*b*, 60*c* and the area of the second portion 30 establish the resonant frequency of the second feeding loop 32.

The bandwidth of the antenna may be related to the difference between the two resonant frequencies. In other words, if the resonant peaks are separated from one another, the frequency range between these two peaks may have the desired characteristics. Thus, the ratio of the total capacitance of the first capacitors 50*a*,50*b*,50*b* to the total capacitance of the second capacitors 60*a*,60*b*,60*c* may define the bandwidth of the antenna.

Further, the center frequency of the antenna and the impedance are also affected by the input capacitor 70, and more specifically, the ratio of the capacitance of the input capacitor 70 to the total capacitance of first capacitors 50*a*,50*b*,50*c* and second capacitors 60*a*,60*b*,60*c*.

Specifically, in one test, the area of the first feeding loop 22 and the values of the input capacitor 70 and the one or more first capacitors 50*a*, 50*b*, 50*c* were selected so as to achieve a resonant frequency of 2.7 GHz. Additionally, the area of the second feeding loop 32 and the values of the input capacitor 70 and the one or more second capacitors 60*a*, 60*b*, 60*c* were selected so as to achieve a resonant frequency of 2.2 GHz.

Figure 3A:
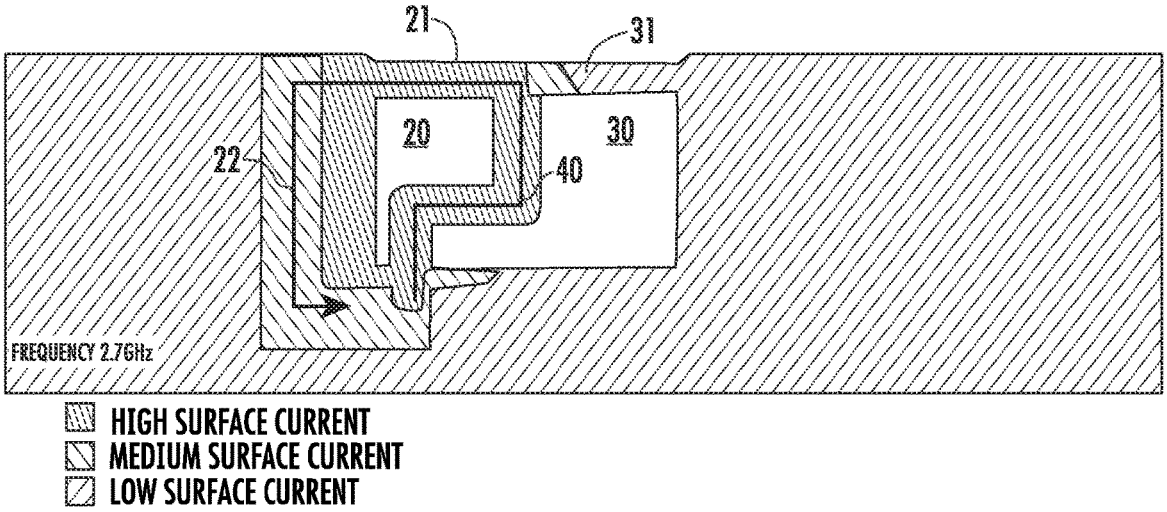
FIG. 3A shows the surface currents generated at high frequency.

FIG. 3A shows the surface currents associated with the higher frequency of 2.7 GHz. Note that far more current passes along the first conductive pathway 21 than along the second conductive pathway 31. Therefore, at this frequency most of the surface current flows through first feeding loop 22.

Figure 3B:
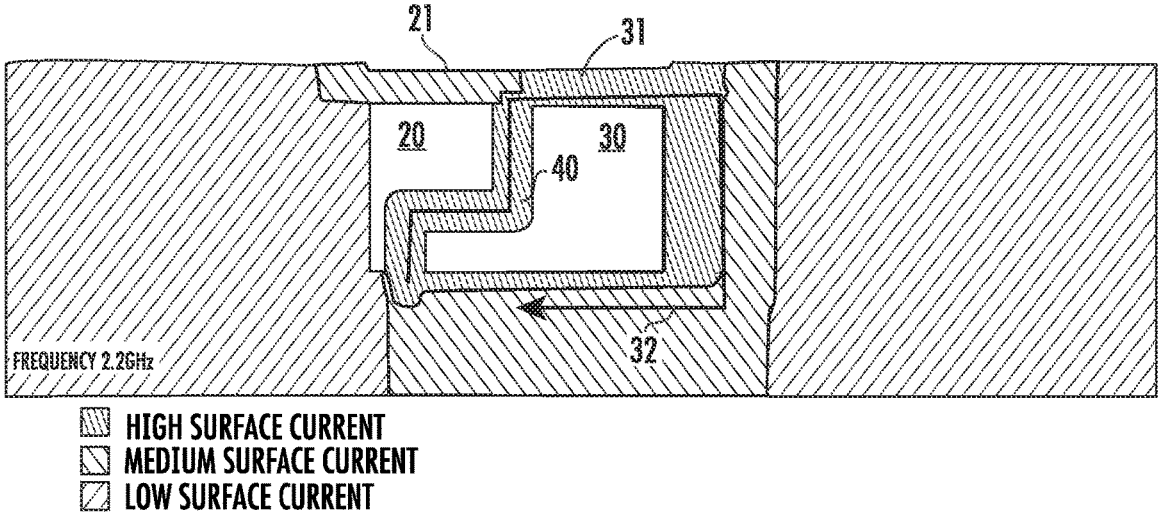
FIG. 3B shows the surface currents generated at a lower frequency.

FIG. 3B shows the surface currents associated with the lower frequency of 2.2 GHz. Note that far more current passes along the second conductive pathway 31 than along the first conductive pathway 21. Therefore, at this lower frequency, most of the surface current flows through second feeding loop 32.

Thus, first feeding loop 22 and the second feeding loop 32 may be configured so as to have frequencies that are close to one another. These feeding loops 22, 32 couple with the antenna radiator loop 90, which enables high efficiency radiation and uniform radiation patterns for the whole frequency band.

Thus, to achieve acceptable performance at an operating frequency of 2.45 GHz, the first resonant frequency may be between 2.1 GHz and 2.45 GHz, while the second resonant frequency may be between 2.45 GHz and 2.8 GHz.

Figure 4:
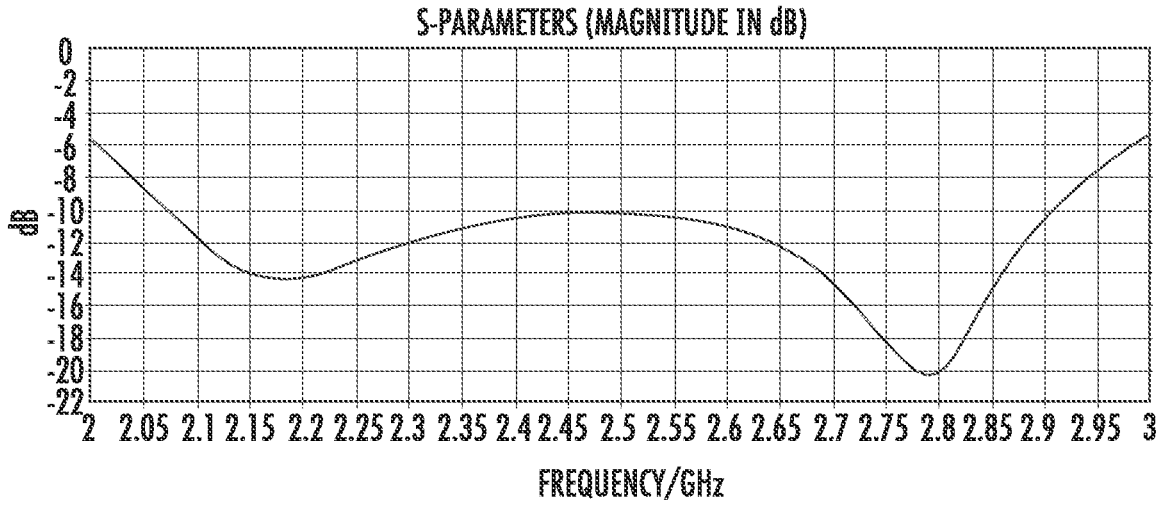
FIG. 4 shows the return loss of the antenna over a broad range of frequencies.

FIG. 4 shows the return loss of the antenna. For this graph and the one in FIG. 5, the ground plane was assumed to be 50 mm×30 mm. Note that the antenna has two resonant frequencies, which are clear in this frequency. Because these frequencies are relatively close to one another, they create a return loss where the return loss is less than −10 dB over a frequency band of over 800 MHz.

Figure 5:
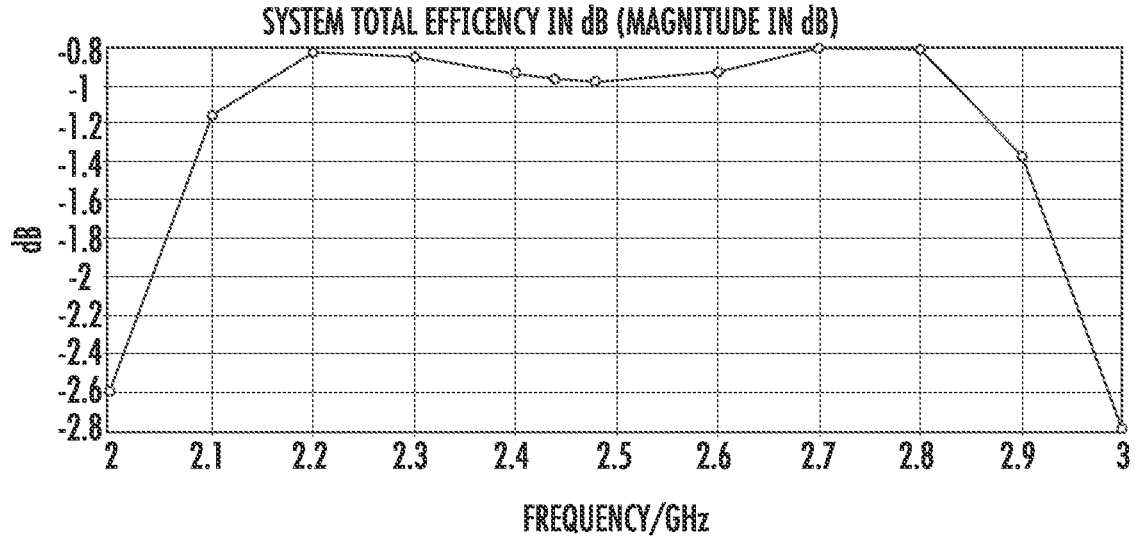
FIG. 5 shows the total efficiency of the antenna over a broad range of frequencies.

FIG. 5 shows the system total efficiency, as measured in dB. In this disclosure, total efficiency ($E_T$) is defined as radiation efficiency ($E_R$), multiplied by the impedance mismatch loss ($M_L$). Further, radiation efficiency is defined as the radiated power ($P_{RAD}$) divided by the input power ($P_{INPUT}$); in other words:

$$E_R = P_{RAD}/P_{INPUT}.$$

Note that the total efficiency is greater than −1.5 dB over a range of over 800 MHz.

The bandwidth achieved by this antenna is important, especially when the antenna is a part of a module that is attached to an end product printed circuit board.

Because of regulatory issues, it is common to utilize an antenna module that has been approved by the regulatory agencies in conjunction with the end product printed circuit board.

Figure 6:
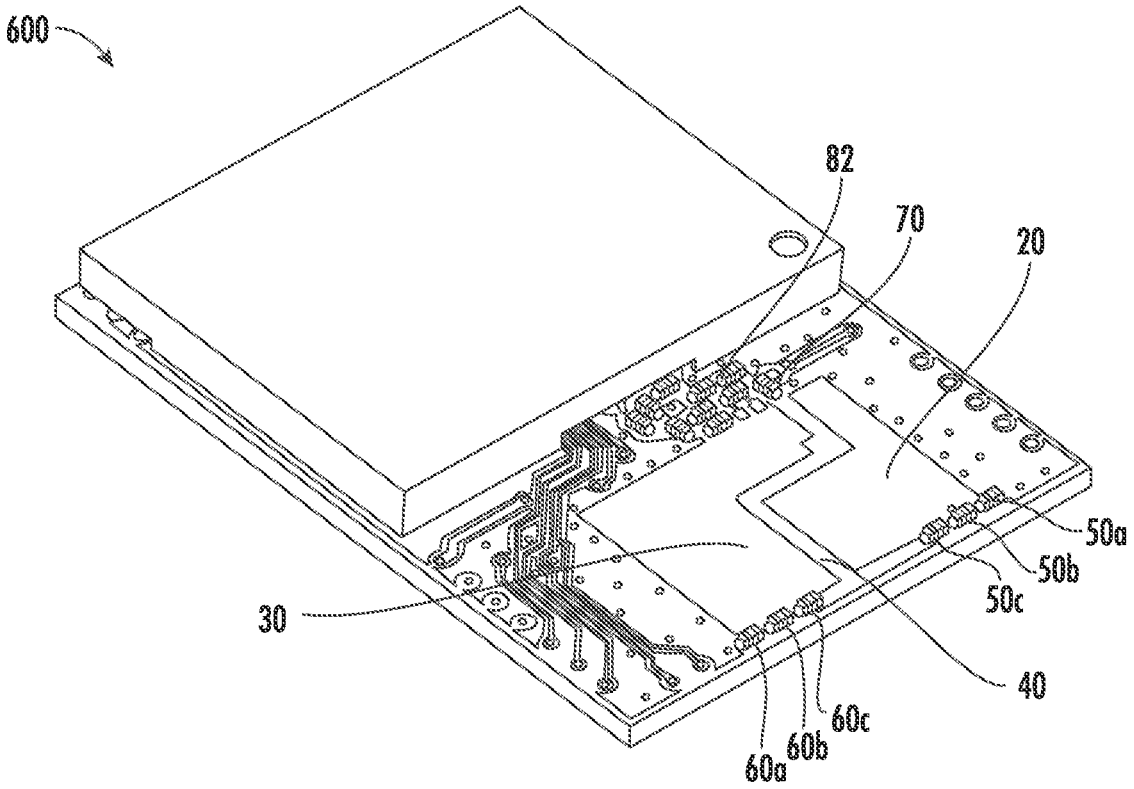
FIG. 6 shows the antenna as part of a module.

FIG. 6 shows the antenna disposed on such a module 600. In this embodiment, the module 600 includes the antenna of FIG. 1. The first capacitors 50*a*, 50*b*, 50*c*, the second capacitors 60*a*, 60*b*, 60*c*, the input capacitor 70, the feeding path 40, the first portion 20 and the second portion 30 are all visible. In addition, the impedance matching circuit 82 is also shown. Additionally, the module may include a crystal, an integrated circuit and various passive components. The integrated circuit may include the power amplifier that is used to drive the antenna. Additionally, in certain embodiments, the integrated circuit may include other hardware associated with the RF network.

The module 600 is then attached to an end product printed circuit board, such as by soldering. When the module 600 is attached to the end product printed circuit, the ground planes are connected. Thus, the overall dimensions of the ground plane, which is important to determining the resonant frequency and the impedance, changes.

Figure 7:
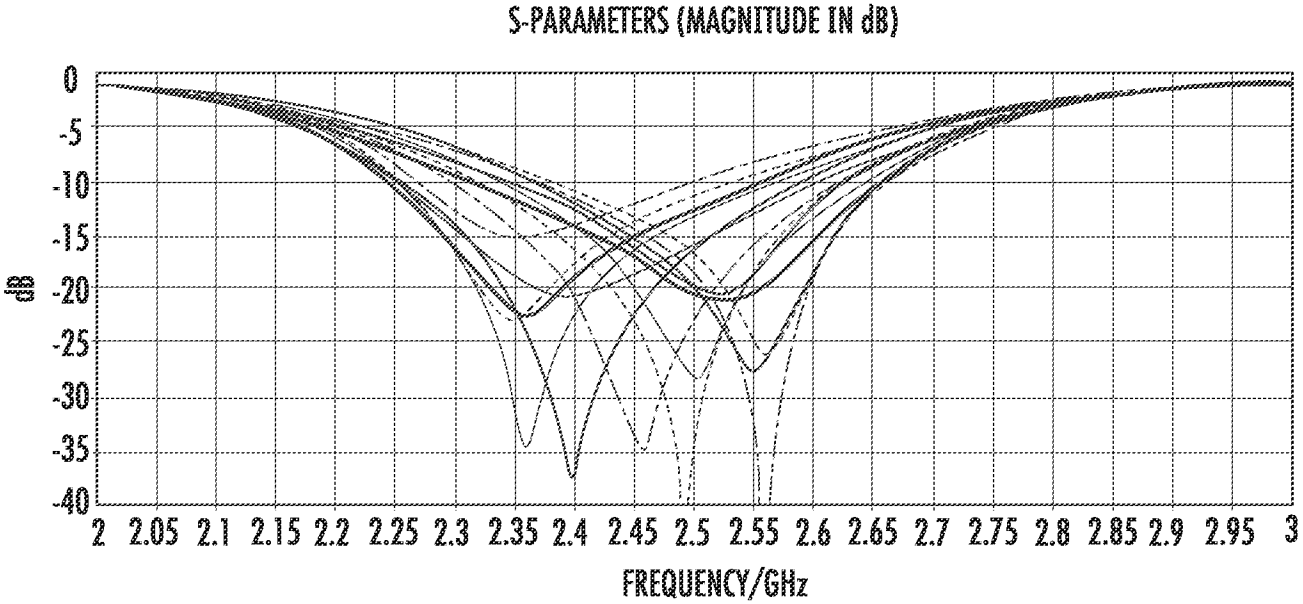
FIG. 7 shows the return loss over frequency as a function of different ground plane dimensions.

By utilizing an antenna which has a dual resonance, the antenna may achieve acceptable performance over a wide range of ground plane dimensions. For example, FIG. 7 shows the return loss measured with a variety of different ground plane dimensions. In this figure, the different graphs represent the performance of the antenna when coupled to ground planes having a range of dimensions, wherein the length varies from 40 mm to 80 mm and the width varies from 40 mm to 80 mm.

Note that in all of the curves, the return loss is at least −10 dB over the frequency range from 2.4 GHz to 2.48 GHz.

This system and method have many advantages. By introducing different capacitance values along the first conductive pathway 21 and the second conductive pathway 31, it is possible to create two resonant frequencies, which are closely spaced. In this way, the return loss may be less than −10 dB over a range of 800 MHz. This allows a high degree of tolerance with respect to the PCB design and capacitor values. Further, this approach does not require the use of inductors.

Additionally, as described above, the antenna may be part of a module that is later mounted to an end product printed circuit board. The dimensions of this end product printed circuit board are unknown and may vary. Thus, by creating an antenna with a dual resonance, the antenna may exhibit acceptable performance over a wide range of ground plane dimensions.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A loop type ground radiation antenna, comprising two resonance frequencies, wherein a first resonance frequency is between 2.1 GHz and 2.45 GHz and a second resonance frequency is between 2.45 GHz and 2.8 GHz, wherein the loop type ground radiation antenna is a wide band antenna having a return loss of less than −10 dB over a range of more than 800 MHz.

2. The loop type ground radiation antenna of claim 1, further comprising one or more first capacitors and one or more second capacitors, wherein values of the one or more first capacitors and the one or more second capacitors are used to determine the two resonance frequencies.

3. The loop type ground radiation antenna of claim 2, wherein a ground clearance is divided into a first portion and a second portion by a feeding path, and wherein an area of the first portion and an area of the second portion is also used to determine the two resonance frequencies.

4. The loop type ground radiation antenna of claim 1, wherein an operating frequency is 2.45 GHz.

5. The loop type ground radiation antenna of claim 1, wherein a difference between the first resonance frequency and the second resonance frequency is at least 500 MHz.

6. A loop type ground radiation antenna, comprising
a conductive ground layer;

a ground clearance disposed in the ground layer, wherein the ground clearance is not electrically conductive, and wherein the ground clearance is disposed near an edge of the ground layer such that a conductive pathway exists between the ground clearance and the edge of the ground layer;

a feeding path traversing the ground clearance to create a first portion and a second portion, wherein a first end of the feeding path contacts the conductive pathway, dividing the conductive pathway into a first conductive pathway and a second conductive pathway;

an input capacitor in communication with a second end of the feeding path;

one or more first capacitors arranged in series along the first conductive pathway; and one or more second capacitors arranged in series along the second conductive pathway, wherein the loop type ground radiation antenna is a wide band antenna having a return loss of less than −10 dB over a range of more than 800 MHz and has two resonance frequencies, and wherein a first resonance frequency is between 2.1 GHz and 2.45 GHz and a second resonance frequency is between 2.45 GHz and 2.8 GHz.

7. The loop type ground radiation antenna of claim 6, wherein an area of the first portion, and a total capacitance of the one or more first capacitors determine the first resonance frequency.

8. The loop type ground radiation antenna of claim 7, wherein an area of the second portion, and a total capacitance of the one or more second capacitors determine the second resonance frequency.

9. The loop type ground radiation antenna of claim 6, wherein an operating frequency is 2.45 GHz.

10. A module comprising:

a loop type ground radiation antenna, comprising:

a conductive ground layer;

a ground clearance disposed in the ground layer, wherein the ground clearance is not electrically conductive, and wherein the ground clearance is disposed near an edge of the ground layer such that a conductive pathway exists between the ground clearance and the edge of the ground layer;

a feeding path traversing the ground clearance to create a first portion and a second portion, wherein a first end of the feeding path contacts the conductive pathway, dividing the conductive pathway into a first conductive pathway and a second conductive pathway;

an input capacitor in communication with a second end of the feeding path;

one or more first capacitors arranged in series along the first conductive pathway; and one or more second capacitors arranged in series along the second conductive pathway, wherein the loop type ground radiation antenna is a wide band antenna wherein a return loss is less than −10 dB over a frequency range from 2.4 GHz to 2.48 GHz for all ground layers having a width between 40 mm and 80 mm and a length between 40 mm and 80 mm.

11. The module of claim 10, wherein the ground layer of the loop type ground radiation antenna is adapted to be electrically connected to a ground layer of a printed circuit board.

12. The module of claim 11, wherein an operating frequency is 2.45 GHz.

13. An assembly, comprising the module of claim 10 and a printed circuit board, wherein a ground layer of the printed circuit board is in communication with the ground layer of the loop type ground radiation antenna.

14. The assembly of claim 13, wherein an operating frequency is 2.45 GHz.

* * * * *